US006132339A

United States Patent [19]

Wang et al.

[11] Patent Number: 6,132,339

[45] Date of Patent: Oct. 17, 2000

[54] TREADING FITNESS TRAINER

[76] Inventors: Leao Wang; Peter Wu, both of No 1, Lane 154, Charng Long Rd., Taiping, 411, Taiwan

[21] Appl. No.: 09/420,228

[22] Filed: Oct. 18, 1999

[51] Int. Cl.[7] ..... A63B 22/04

[52] U.S. Cl. ..... 482/53; 482/52

[58] Field of Search ..... 482/51, 52, 53, 482/57, 146, 147

[56] References Cited

U.S. PATENT DOCUMENTS 5,575,739 11/1996 Piaget et al. ..... 482/51
5,645,512 7/1997 Yu ..... 482/53
5,749,809 5/1998 Lin ..... 482/52
5,906,561 5/1999 Lin ..... 482/52
5,938,569 8/1999 Lin ..... 482/147

*Primary Examiner*—Stephen R. Crow
*Attorney, Agent, or Firm*—Dougherty & Troxell

[57] ABSTRACT

A treading fitness trainer with a vertical rod on which a plurality of pivoted shafts are respectively disposed in order to connect the vertical rod with a handgrip connecting rod, an upper toothed disk, a lower toothed disk, a resistance device and a pedal connecting rod. The upper toothed disk and the handgrip connecting rod are connected with each other, and the upper and lower toothed disks are engaged with each other. The lower toothed disk is pivoted with a pull rod at one side which is connected to the pedal connecting rod, the other side of said lower toothed disk being connected to an operation shaft of a resistance device.

3 Claims, 5 Drawing Sheets

TREADING FITNESS TRAINER

BACKGROUND OF THE INVENTION

1. Field of the Invention

The present invention relates to a treading fitness trainer, and more particularly, to a device which insures the coupling relationship between the handgrip connecting rod and the pedal connecting rod so that the pivoted elements cannot be loosened.

2. Description of the Prior Art

The prior art of U.S. Pat. 5,518,470 (an expansion invention of the prior art of U.S. Pat. 5,575,739), as shown in FIGS. 4 and 5, includes at least one resistance device 14 between a handgrip connecting rod 10 and a pedal connecting rod 12, wherein the motion of the human limbs (as shown in FIG. 5) can be simulated to achieve exercise. The resistance device 14 has an extendable shaft 16 and is coupled between the handgrip connecting rod 10 and the pedal connecting rod 12.

The pivoted connection elements 18 of the resistance device 14 will be easily loosened since they are directly forced by the motion of the handgrip connecting rod 10 and the pedal connecting rod 12. Accordingly, the users often encounter a slight play during the initial motion and the pivoted connection elements 18 must be frequently inspected and secured if they are loosened.

SUMMARY OF THE INVENTION

It is a main object of the present invention to provide a treading fitness trainer in which a handgrip connecting rod and a pedal connecting rod can be operated in a coupled state by an upper and lower toothed disks and a pull rod. Moreover, the motion direction of the handgrip connecting rod and the pedal connecting rod can be kept consistent because of the engagement of the teeth of the upper and lower toothed disks. In addition, a resistance device is indirectly forced by the motion of the lower toothed disk, rather than being forced by the motion of the handgrip connecting rod and the pedal connecting rod, so that pivoting elements can be prevented from being loosened.

BRIEF DESCRIPTION OF THE DRAWINGS

The drawings disclose illustrative an embodiment of the present invention which serve to exemplify the various advantages and objects thereof, and are as follows.

DETAILED DESCRIPTION OF THE PREFERRED EMBODIMENT

Figure 1:
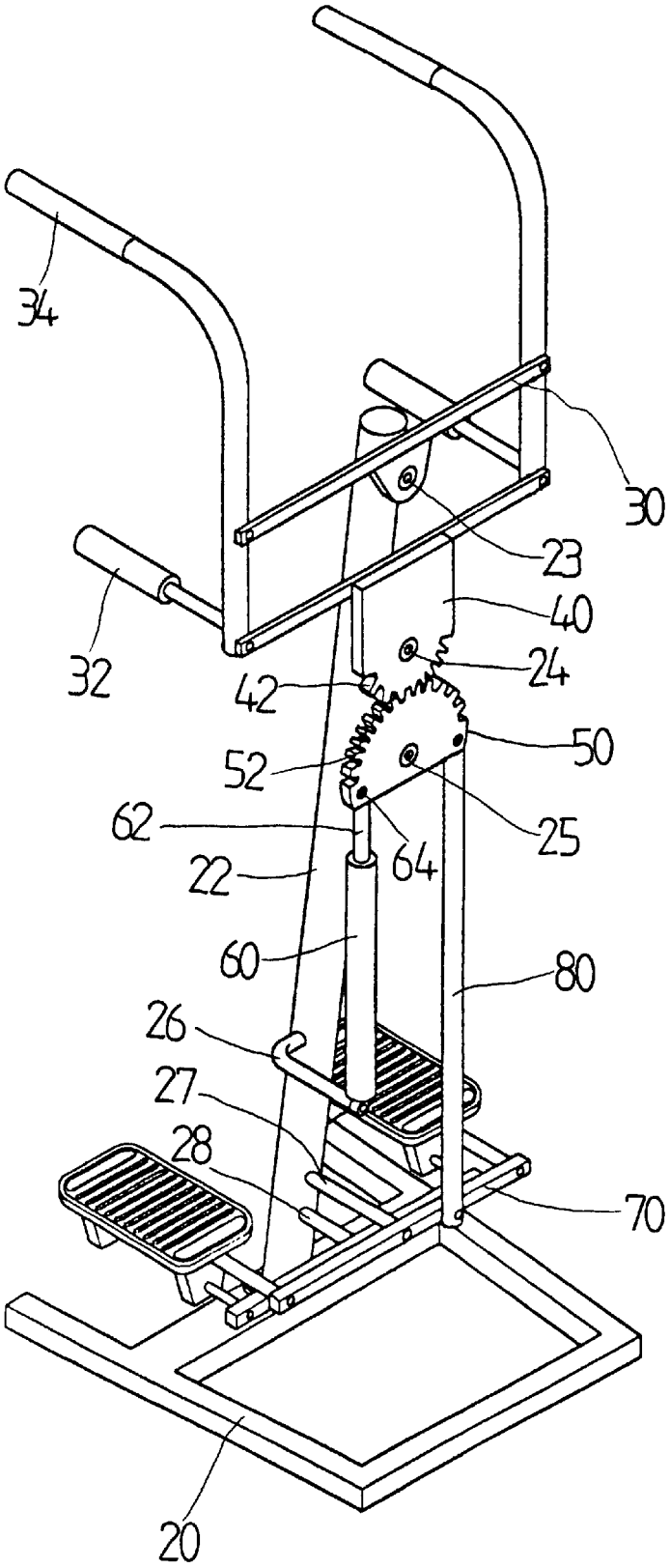
FIG. 1 is a perspective view of the present invention.

First of all, referring to FIG. 1, the treading fitness trainer in accordance with the present invention includes a base 20 with a vertical rod 22, on which is provided a plurality of pivot shafts 23, 24, 25, 26, 27, 28 respectively disposed from the top to the bottom thereof connected in order with a handgrip connecting rod 30, an upper toothed disk 40, a lower toothed disk 50, a resistance device 60 and a pedal connecting rod 70. The upper toothed disk 40 and the handgrip connecting rod 30 are connected with each other, and the upper and lower toothed disks 40, 50 are engaged with each other by teeth 42 and 52. The lower toothed disk 50 is pivoted to a pull rod 80 at one side thereof, the pull rod 80 being connected to the pedal connecting rod 70. The other side of the lower toothed disk 50 is pivotally connected to an operation shaft 62 of the resistance device 60.

Figure 2:
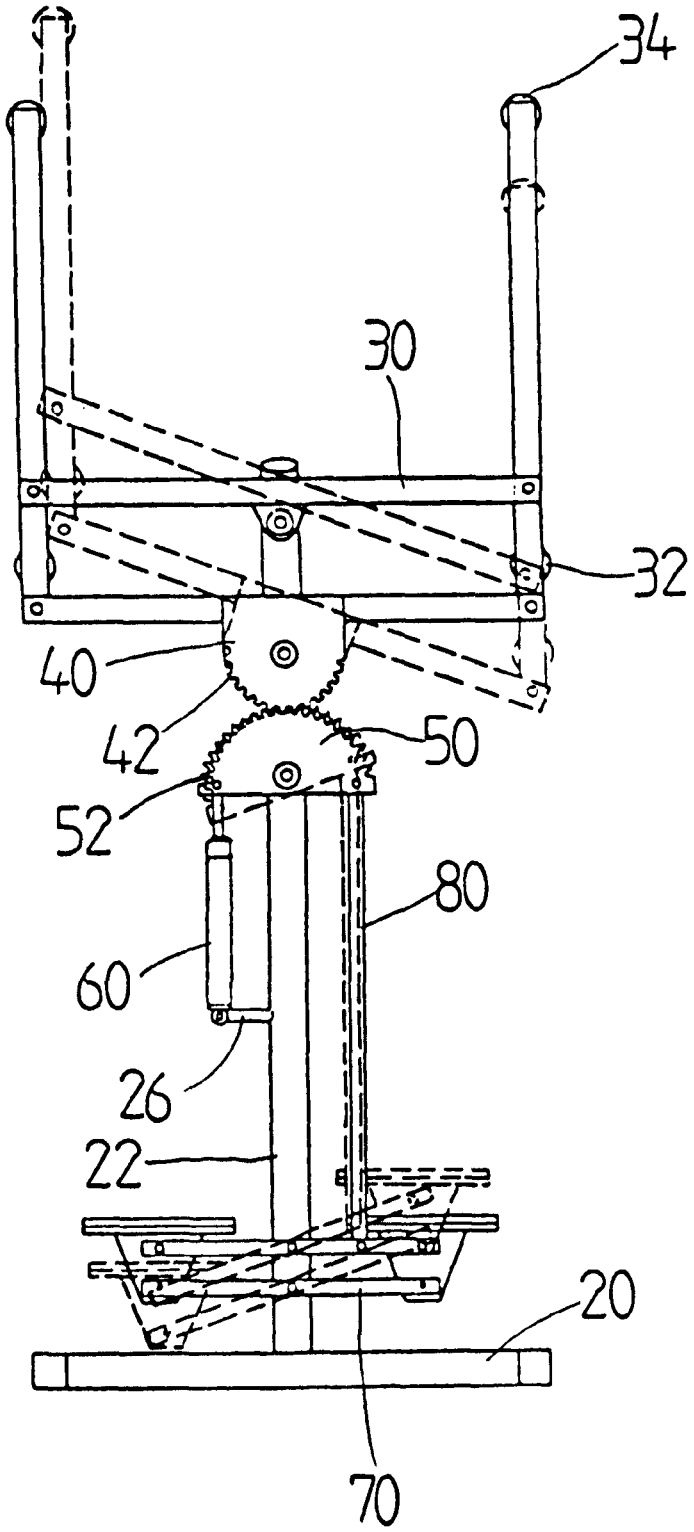
FIG. 2 is a front schematic view of the present invention, illustrating one operation direction thereof.
Figure 3:
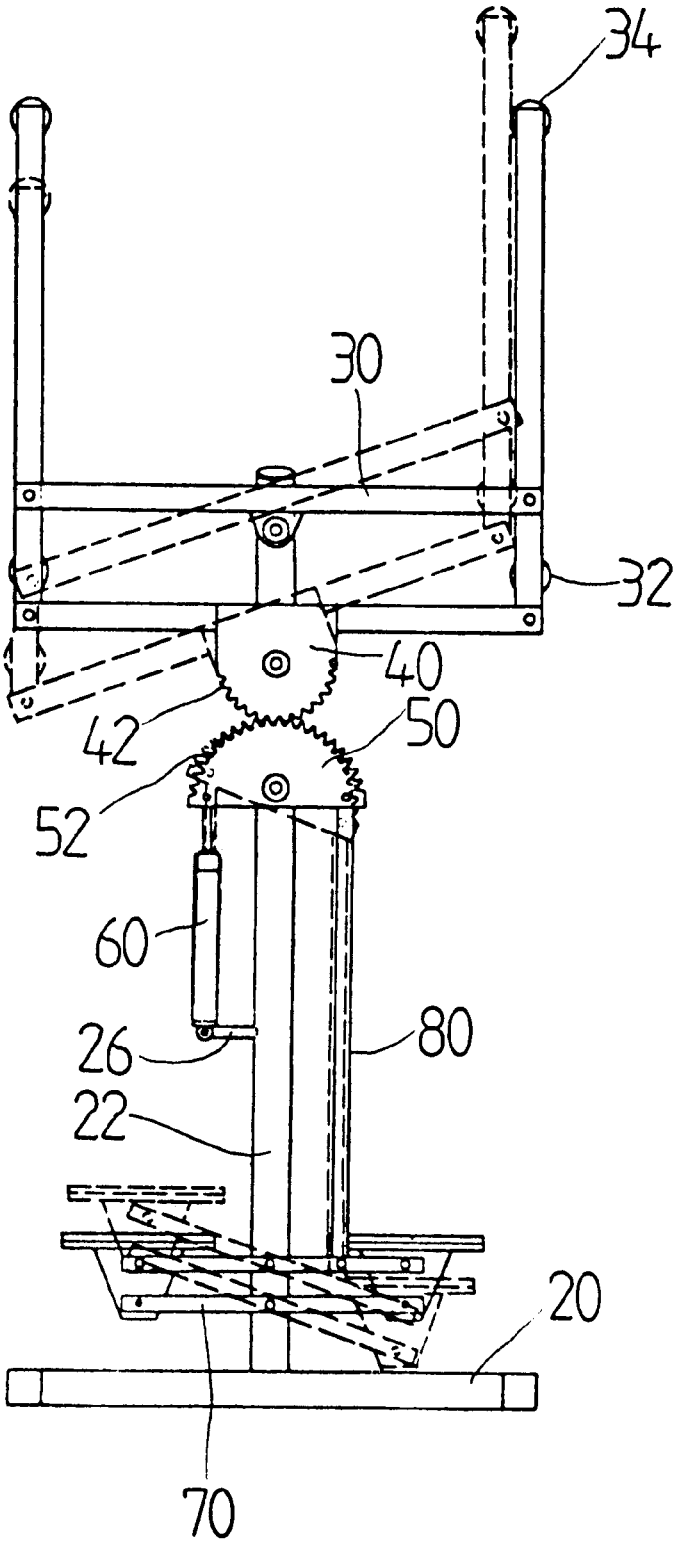
FIG. 3 is a front schematic view of the present invention, illustrating another operation direction thereof.
Figure 4:
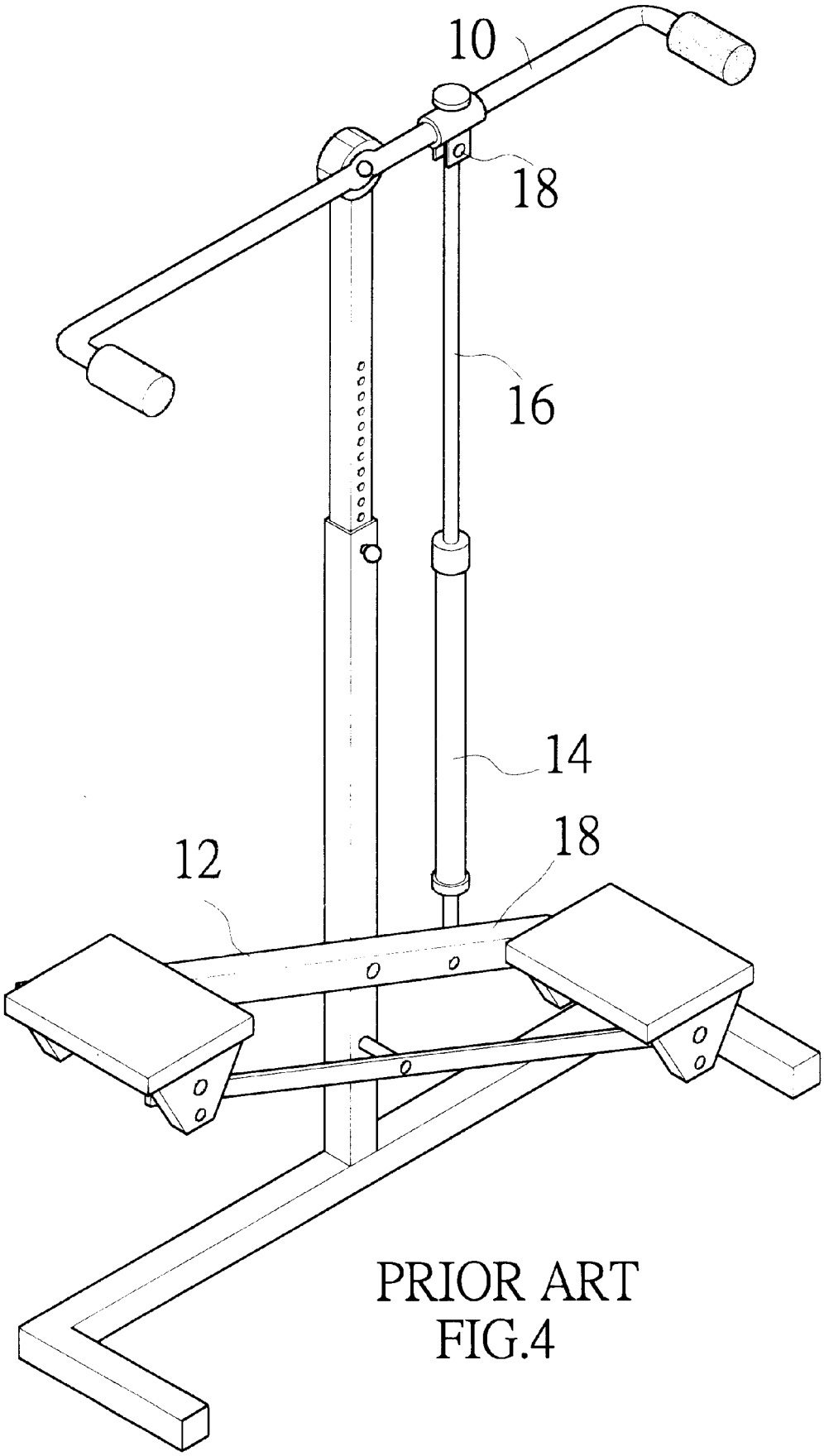
PRIOR ART FIG.4
FIG. 4 is a perspective view in accordance with the prior art.
Figure 5:
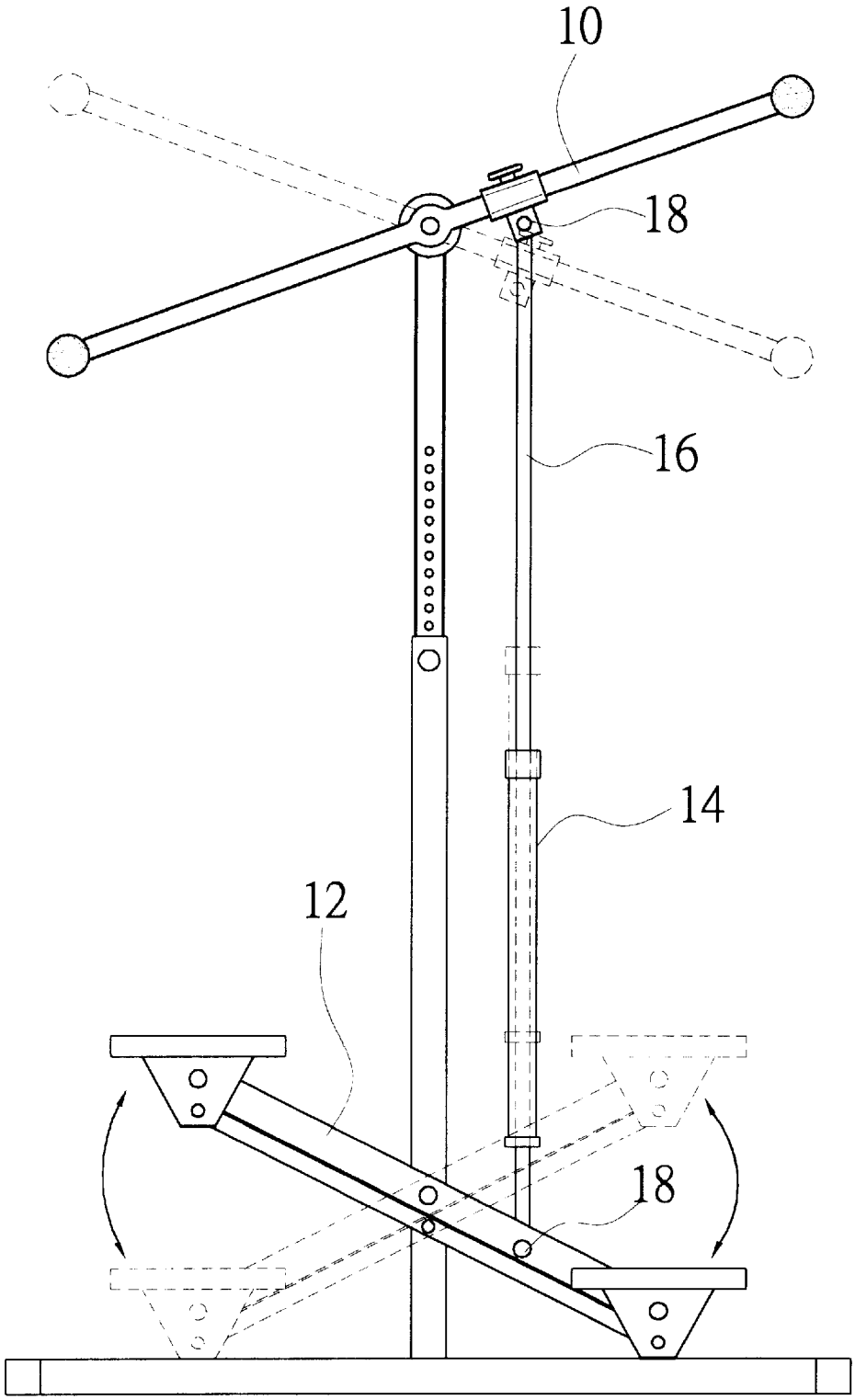
PRIOR ART FIG. 5
FIG. 5 is a schematic drawing in accordance with the prior art.

Furthermore, referring to FIGS. 2 and 3, the handgrip connecting rod 30 and the pedal connecting rod 70 can be operated in a coupled state by the upper and lower toothed disks 40, 50, and the pull rod 80, whenever the handgrip connecting rod 30 or the pedal connecting rod 70 is forced to make an upward or downward movement. Moreover, the motion direction of the handgrip connecting rod 30 and the pedal connecting rod 70 can be kept consistent because of the engagement of the teeth 42, 52 of the upper and lower toothed disks 40, 50.

In addition, the resistance device 60 is disposed between the lower toothed disk 50 and the vertical rod 22 and its actuation is created by the motion of the lower toothed disk 50, rather than by the motion of the handgrip connecting rod 30 or the pedal connecting rod 70 of the prior art. Thus, the pivoting connecting element 64 of the resistance device 60 can be prevented from becoming loosened.

In order to achieve different motions of the upper and lower limbs of the human body, the diameter of the upper toothed disk 40 is smaller than that of the lower toothed disk 50.

In order to provide the user with different heights, the handgrip connecting rod 30 includes first handgrips 32 and second handgrips 34 respectively at two sides thereof for the users to choose an appropriate holding height.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A treading fitness trainer comprising:

a) a base having a rod extending upwardly therefrom;

b) a handgrip assembly including at least one pair of handgrips and a handgrip connecting rod pivotally connected to an upper portion of the upwardly extending rod;

c) an upper toothed disk, having a toothed portion with first teeth, pivotally connected to the upwardly extending rod and connected to the handgrip connecting rod such that pivoting motion of the handgrip connecting rod causes pivoting motion of the upper toothed disk;

d) a lower toothed disk pivotally connected to the upwardly extending rod and having a toothed portion with second teeth engaging the first teeth such that pivoting motion of the upper toothed disk causes pivoting motion of the lower toothed disk;

e) a pedal assembly having a plurality of foot pedals and a pedal connecting rod pivotally connected to a lower portion of the upwardly extending rod;

f) a pull rod connecting a first side of the lower toothed disk to the pedal connecting rod such that the lower toothed disk and the pedal connecting rod pivot together; and, g) a resistance device connected to a second, opposite side of the lower toothed disk and to the upwardly extending rod to provide a resistance to the pivoting motion of the lower toothed disk.

2. The treading fitness trainer of claim 1 wherein a radius of the toothed portion of the upper toothed disk is smaller than a radius of the toothed portion of the lower toothed disk.

3. The treading fitness trainer of claim 1 wherein the handgrip assembly comprises first and second pairs of handgrips, the first pair of handgrips being located at a lower height above the base than the second pair of handgrips.

* * * * *